United States Patent [19]

Ahner et al.

[11] 4,302,680

[45] Nov. 24, 1981

[54] COVER CONSTRUCTION FOR SHIELDING CONTAINERS FOR THE STORAGE AND TRANSPORATION OF IRRADIATED FUEL ELEMENTS

[75] Inventors: Stefan Ahner, Rodenbach; Hans-Günther Knackstedt, Langenselbold; Peter Strostlik, Bruchkobel, all of Fed. Rep. of Germany

[73] Assignee: Transnuklear GmbH, Hanau, Fed. Rep. of Germany

[21] Appl. No.: 55,405

[22] Filed: Jul. 6, 1979

[30] Foreign Application Priority Data

Aug. 7, 1978 [DE] Fed. Rep. of Germany ..... 2830111

[51] Int. Cl.[3] ..... G21F 5/00

[52] U.S. Cl. ..... 250/506

[58] Field of Search ..... 250/506, 507, 515, 518; 176/67, 79

[56] References Cited

U.S. PATENT DOCUMENTS 3,710,121 1/1973 Bedrosian ..... 250/506

3,982,134 9/1976 Housholder ..... 250/506

FOREIGN PATENT DOCUMENTS 2738592 3/1979 Fed. Rep. of Germany ..... 250/506

*Primary Examiner*—Bruce C. Anderson

*Attorney, Agent, or Firm*—Cushman, Darby & Cushman

[57] ABSTRACT

There is provided a cover construction for a shielding container for the transportation and storage of fuel elements essentially consisting of an inner shielding cover and an outer transportation cover flanged on the cover, the inner shielding cover consisting of a fixed cover portion and a moveable cover portion provided at the rim of the cover with claws, whereby the claws are fitted into corresponding openings of the top of the container and the connection between the fixed cover portion and the moveable cover portion takes place through a screw carried into the moveable portion and a pin fitting into the fixed portion.

2 Claims, 2 Drawing Figures

COVER CONSTRUCTION FOR SHIELDING CONTAINERS FOR THE STORAGE AND TRANSPORATION OF IRRADIATED FUEL ELEMENTS

BACKGROUND OF THE INVENTION

The invention is directed to a cover construction for shielding containers for the transportation and/or for the storage of irradiated fuel elements, essentially consisting of an inner shielding cover and an outer transportation cover flanged on the container.

For the transportation and storage of irradiated or burned up fuel elements from nuclear reactors there are needed containers which safely hold back the radioactivity of the material. The construction of this container therefore is subject to severe requirements, above all what concerns the indestructability of the container in the case of accidents is the protection of the environment from radioactive rays.

The container for the transportation and for storage of irradiated fuel elements therefore must be constructed to be durable and sturdy and must offer a protection from radioactive rays. However, in this connection the material for radioactive shielding is so selected that the weight of the shielding, which makes up the greatest part of the weight of the transportation container, is held as small as possible for economical reasons. Besides attention must be paid that the heat of decomposition of the transported or stored fuel elements can be safely led outside.

Of especial importance with such shielding containers there is also the closing device of this shielding container, generally a cover or a cover system which after loading the container with irradiated fuel elements stays tight and which container interior must be hermetically shut off from the outer world.

With the previously known shielding containers the cover consists of, for the most part, of a cylindrical closure plug, partially applied to the container wall, which plug simultaneously carries the shielding and the sealing function. This cover is normally attached to the container with screw bolts. This container, however, has the disadvantage that a dry loading and unloading with irradiated fuel elements is only possible if an allowance is made for a contamination with subsequent expensive decontamination of the entire system. Besides frequently with such containers there is shown sealing problems, since the seal in the case of accident is laden with the total weight of the cover and the container contents. A change of seal with the loaded container is only possible by remote control whereby here also there must be taken into consideration an increased difficulty in handling through the great size of the cover.

Therefore there have already been proposed a closure apparatus for shielding containers of multipe-part cover construction. Thus it is known for example from German GM 7727690 to provide the container with an inner shielding cover and an outer security or transportation cover, the two of which are directly flanged on the container. However, here also a dry unloading is only possible if a decontamination of the entire system is undertaken. Besides there is necessary a high manipulative expense for removal of the cover, since both are constructed as flange cover and the set screws must be detached or inserted.

Therefore it was the problem of the present invention to provide a cover construction for the transportation and/or the storage of irradiated fuel elements essentially consisting of an inner shielding cover and an outer transportation cover flanged onto the container which can be handled simply and without large manipulative expense, is suited for both dry and wet loading and unloading without danger of contamination and creates no sealing problems.

SUMMARY OF THE INVENTION

This problem was solved by the invention by making the inner shielding cover of a fixed cover portion and a moveable cover portion provided at the rim with claws, whereby the claws are fitted into corresponding openings of the top of the container to form a bayonet connection and the connection between the fixed and moveable cover portion takes place through a screw carried into the moveable portion and a pin fitting into the fixed portion.

BRIEF DESCRIPTION OF THE DRAWINGS

In FIGS. 1 and 2 in each case the left half of the figure shows the shielding cover in the closed condition and the right half of the figure reproduces the shielding cover in the open condition.

Figure 1:
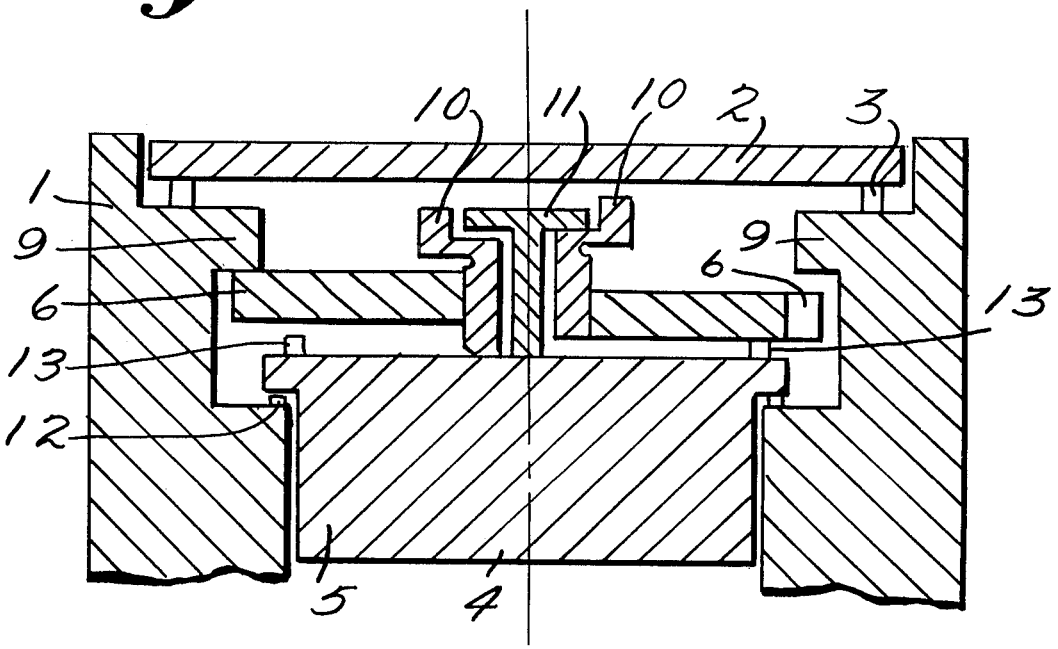
FIG. 1 shows schematically in longitudinal section an illustrative form of the cover system of the invention.
Figure 2:
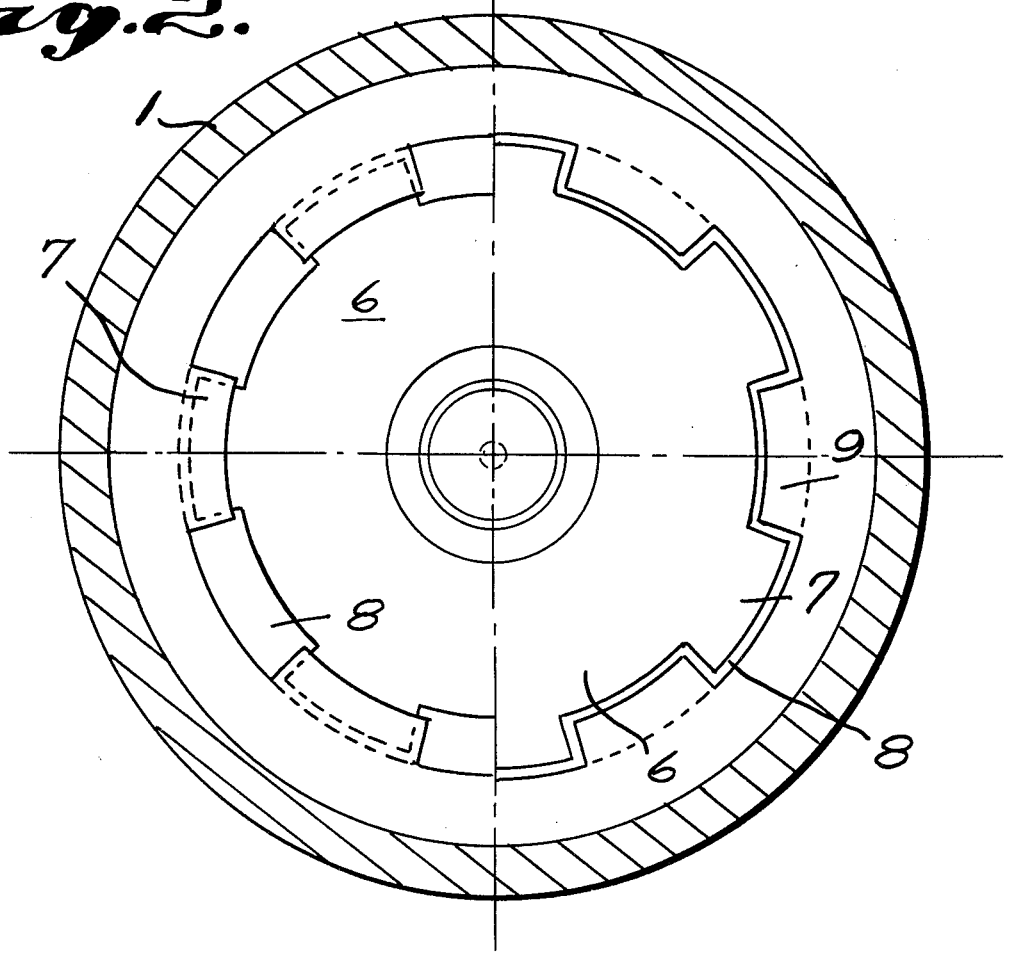
FIG. 2 is a schematic cross section of an illustrative form of the invention.

The cover of the invention can comprise, consist essentially of or consist of the stated parts.

DESCRIPTION OF THE PREFERRED EMBODIMENTS

The shielding container 1 has an outer transportation cover 2 flanged in any manner on the container 1 to securely include the free radioactivity by means of seals 3 and to protect mechanically against outside influences. Below the transportaion cover 2 there is located the shielding cover 4 for securely sealing the gamma and neutron rays from the irradiated fuel elements against the environment.

The shielding cover 4 consists of fixed cover portion 5 and a moveable cover portion 6 which are joined together in such manner that they both twist toward each other as well as also being able to be spreaded. The moveable cover portion 6 has distributed at its periphery claws 7 which fit into corresponding openings 8 of the top of the container 9. They are fastened on the container by twisting according to the principle of the bayonet.

The connection between the fixed cover portion 5 and the moveable cover portion 6 of the shielding cover 4 takes place with a screw 10 carried into the moveable cover portion 6 and a pin 11 fitting into the fixed cover portion. By turning in the screw 10 the moveable cover portion 6 is moved away from the fixed cover portion 5 so that a twisting of the moveable cover portion 6 is no longer possible and the seal 12 is so fixed between the fixed cover portion 5 and the container 1 that there is guaranteed the sealing of the container contents against the outer world. To open the shielding cover 4 the spread between the fixed cover portion 5 and the moveable cover portion 6 is decreased through turning the screw 10 outwardly so that by turning of the moveable cover portion around a length of claw both can be raised and the shielding cover 4 can be lifted off. Moreover, screw 10 can be operated either manually or also mechanically by remote control. By further turning out of the screw 10 the moveable cover portion 6 and the fixed cover portions 5 are supported via the pin 11. Thereby the seal 13 tightens the gap 14 between the two cover portions and thus prevents a contamination of this gap.

The transportation cover 2 has the function correspondingly to safely seal in the container contents of the transportation container order. It is removed inside the control area for loading and unloading since the shielding cover 4 guarantees a sufficient protection in this area. The transportation cover 2 is secured at the flange of the top 9 of the container with screws (not shown), preferably clamping screws, distributed around the periphery of the transportation cover, through which the necessary compressive strength for tightening the seal 3 can be applied. This seal 3 is so designed that it fulfills the required packing both in the failure of the seal 12 and also in all loads occurring in accidents of design.

The function of the cover system of the invention will be further explained in connection with an unloading process employing dry unloading.

First the transportation cover 2 is removed in the control area and the transportation container 1 flanged on the container flange under a hot cell lock. The shielding cover 4 then is connected with the hot cell cover and the spread between the two cover portions 5 and 6 of the shielding cover 4 lowered by remote control turning of the screw 10. The moveable cover portion 6 is turned in the opening position and the two cover portions 5 and 6 brought together by further turning of the screw 10 so that the gap 14 is made tight by the seal 13.

The shielding cover 4 can now be turned with the hot cell cover in the hot cell without the surface of the shielding cover 4 and the gap 14 being contaminated (double cover system).

The cover system of the invention has a number of advantages over the known covers for shielding containers.

The dry loading and unloading into or on a hot cell is possible without danger of contamination of the cover system, exactly as the wet loading and unloading in a water vessel. In an accident the transportation cover 2 is not loaded with the weight of the contents of the container and the shielding composition of the shielding cover 4. The dimensioning of the set screw 10 therefore can by itself alone adjust for the sealing after the required initial stress.

The seal 3 guaranteeing the tightness of the container system is substantially shielded from gamma and neutron irradiation. The operating temperatures for this sealing system therefore are moderate. The seal 12 protects it in the normal operation extensively from radioactive gases and steam (in wet transport) which largely prevents a premature aging. Besides this sealing system 3 is easily accessible for maintenance and inspection.

By constructing the shielding cover 4 as a bayonet closure to open the cover there is only needed a central turning movement which can be carried out readily either by remote control or manually. Because of the division of the shielding cover in two parts it is not necessary to turn the entire cover.

The entire disclosure of German priority application No. P 28 30 111.3 is hereby incorporated by reference.

What is claimed is:

1. A cover construction for a shielding container for the transportation and/or storage of radioactive fuel elements comprising:

an outer transportation cover detachably, sealingly securable to an outer rim portion of the container;

an inner shielding cover comprising an inner cover portion having overlapping sealing engagement with an inner rim portion of the container and an outer cover portion movable inwardly and outwardly relative to said inner portion;

means defining a bayonet connection between said outer cover portion and the container; and screw and stop means connecting said inner and outer cover portions whereby rotation of said screw means effects limited inward and outward relative movement between said outer and inner cover portions.

2. The cover construction defined in claim 1 including sealing means interposed between the peripheral portions of the inner and outer cover portions to effect a seal therebetween on relative movement of said portions toward each other.

* * * * *